US006250632B1

(12) United States Patent
Albrecht

(10) Patent No.: US 6,250,632 B1
(45) Date of Patent: Jun. 26, 2001

(54) AUTOMATIC CARD SORTER

(76) Inventor: James Albrecht, 5209 Gentle River, Las Vegas, NV (US) 89130

( * ) Notice: Subject to any disclaimer, the term of this patent is extended or adjusted under 35 U.S.C. 154(b) by 0 days.

(21) Appl. No.: 09/444,613

(22) Filed: Nov. 23, 1999

(51) Int. Cl.[7] ..... A63F 1/12
(52) U.S. Cl. ..... 273/149 R; 273/149 P
(58) Field of Search ..... 273/149 P, 149 R, 273/151

(56) References Cited

U.S. PATENT DOCUMENTS

| | | | |
|---|---|---|---|
| 1,846,063 | 2/1932 | Matthaey . | |
| 2,661,215 | 12/1953 | Stevens . | |
| 3,452,509 | 7/1969 | Hauer . | |
| 3,575,748 | 4/1971 | Holme . | |
| 4,247,008 | 1/1981 | Dobbs . | |
| 4,388,994 | 6/1983 | Suda et al. . | |
| 4,497,488 | 2/1985 | Plevyak et al. . | |
| 4,513,969 | 4/1985 | Samsel, Jr. . | |
| 4,515,367 | 5/1985 | Howard . | |
| 4,566,595 | 1/1986 | Fustier . | |
| 4,601,396 | 7/1986 | Pavie . | |
| 4,807,884 | 2/1989 | Breeding . | |
| 4,921,109 | 5/1990 | Hasuo et al. . | |
| 4,969,648 | 11/1990 | Hollinger et al. . | |
| 5,248,142 | 9/1993 | Breeding . | |
| 5,261,667 | 11/1993 | Breeding . | |
| 5,275,411 | 1/1994 | Breeding . | |
| 5,288,081 | 2/1994 | Breeding . | |
| 5,303,921 | 4/1994 | Breeding . | |
| 5,382,024 | 1/1995 | Blaha . | |
| 5,417,430 | 5/1995 | Breeding . | |
| 5,431,399 * | 7/1995 | Kelley | 273/149 |
| 5,437,462 | 8/1995 | Breeding . | |
| 5,445,377 | 8/1995 | Steinbach . | |

OTHER PUBLICATIONS

"Sigma–A New Direction", *Showcase*, Oct. 1995, by sigma®game inc.

* cited by examiner

*Primary Examiner*—Jeanette Chapman
*Assistant Examiner*—Zelalem Eshete
(74) *Attorney, Agent, or Firm*—Patents+TMS

(57) ABSTRACT

An apparatus and method for sorting cards into a predetermined sequence. One embodiment provides a deck holding area in which cards are held for presenting a card to a read head for reading the characters on the face of the card. The apparatus also has a tray having a sequence of slots and a card moving mechanism for moving the presented card from the deck holding area into one of the slots. The tray is connected to a tray positioning mechanism for selectively positioning the tray to receive a card in one of the slots from the card moving mechanism. A controller is connected to the read bead, the card moving mechanism, and the tray positioning mechanism. The controller controls the reading of each of the cards by the read head and identifies the value of each card read, and also controls the card moving mechanism to move each of the cards to a slot of the tray positioned by the tray positioning mechanism according to the predetermined sequence of values. The method for sorting includes the step of providing a tray having a sequence of slots, determining a predetermined sequence of values for the cards, and reading the face of a card to determine the value the card. The method further includes moving the read card into one of the of slots of the tray. The position of the slot into which the read card is moved corresponds to the position of the value in the predetermined sequence.

4 Claims, 8 Drawing Sheets

20
ET
30
80
POS.
R
36
104

20
30
FT
83
80
POS.
R
36
104

20
38
40
42
36
104
96
ET
30
POS.
B 46
42
36
90
104
96
20
ET
30

START
134
136
ENTER # DECKS
138
SELECT SEQUENCE
140
GET SEQUENCE
READ BOTTOM CARD
144
IDENTIFY AND STORE VALUE
146
DETERMINE CLOSEST SLOT
148
POSITION TRAY
150
ACTIVATE ROLLER
151
152
DONE ?
NO
YES
154
VERIFY COUNT, CHECK DECK INTEGRITY
157
CORRECT ?
No
ISSUE ERROR SIGNAL
156
Yes
STORE SEQUENCE OF ORIGINAL DECK
159
FLIP TRAY
158
RAISE PLATFORM
160
162
163
CARDS REMOVED ?
WAIT
YES
DONE

AUTOMATIC CARD SORTER

BACKGROUND OF THE INVENTION

1. Field of the Invention

The present invention relates to card sorting devices, and more particularly, to automatic card sorting devices.

2. Statement of the Problem

Card games requiring a plurality of game cards are quite common. Card games generally require that the plurality of cards be reordered (shuffled) to provide a random distribution so that no advantage is given to any participant in the play of the game based on the likelihood of a particular card being at or near a particular location. To achieve this random distribution the cards are usually shuffled several times by a person acting as a dealer. The processes typically employed by dealers result in reordering the game cards in a deck that approaches but does not achieve randomness. Consequently certain skilled individuals are able to locate or nearly locate cards critical to the play with a degree of accuracy sufficient to gain a sizable edge in the play of the game. This process has been well documented for the game of BLACKJACK and is normally referred to as "shuffle-tracking".

Recently, mechanical shufflers have been designed to perform the shuffling, and some of these are controlled by computer components to assist in the physical movements involved. However, all current methods involve a mechanical shuffle mimicking the process used by the human dealer, and like the shuffle produced by a human dealer, such methods approach but do not achieve randomness. Many of these machines have a tendency to move a number of cards at a time so that it is possible that several adjacent cards will remain together before and after the shuffle. In any event, shuffles produced by a human or a mechanical device are difficult to test for randomness in the real environment of a gaming table.

Additionally, it is desirable to know that the plurality of cards is intact in terms of card suit information, the number of cards of a specific rank, as well as total number of cards in the plurality. This is valuable in that the introduction of additional cards or the removal of certain cards can have a dramatic effect on the probabilities involved in the play of the game.

All shuffling techniques produce a certain amount of stress or friction to the card surfaces thus affecting the life of the cards. Therefore, it is desirable to achieve the shuffle with as little card movement as possible. Mechanical designs tend to require repeated shuffles (or "riffles") to achieve randomness.

It is further desirable that a card sorting device be used to return the plurality of cards to the "as new" sequence (referred to herein as the "new" sequence) for storage, sale, or reintroduction to the game at a later time. In BLACKJACK it is common to frequently introduce new decks of cards frequently. When removed from the tables, these decks are sorted back into new sequence by hand, stored and sold in gift ships, vending machines located in the casino or to various wholesalers. After sorting, these cards are usually drilled, dog-eared, or otherwise altered so as to distinguish these from new decks. It is estimated that some 10,000 BLACKJACK tables in America use over 30 million decks each year, most being sorted back to original ("new") order by hand.

Furthermore, several games require a specific sequence that is not random, but is different than the sequence of a typical "new" deck. For instance, in poker, the deck is presented to the table for play by spreading the cards on the table. The suit order required in poker is spades, hearts, clubs, and diamonds. It is common to use cards that are alternatively presented to the table for play, removed and resorted to this sequence, and then used in play again. Such a sequence, which is not random but dictated by the play of the game, is referred to herein as a "game play" sequence. The constant sorting is currently accomplished by various employees as a secondary duty.

It is also desirable to verify that a winning hand indeed came from the dealer's deck and did not come from another deck. Many games offer large prizes for certain infrequent card combinations, such as Caribbean Stud in which the jackpots are often over $100,000. The added security of being able to verify a hand by checking the card sequence of the card deck is of importance to casinos offering such games in order verify winning hands.

It would be desirable to have a single device to solve the above stated problems that is compact, adaptable to mounting on a gaming table, and that requires little operator skill or training. Such a device should shield the sorting process from view of the players, and should be free of annoying sounds or vibrations. Also, the device should be fast, accomplishing a complete sort in less than one minute. The prior art is devoid of any single device or process capable of sorting into a random, new, or game play predetermined sequence and having these characteristics.

3. Solution to the Problem

The present invention satisfies the aforementioned needs by providing an automatic card sorter that either provides a shuffled stack with a predetermined random sequence or sorts a stack into a new, game play, or other user-defined predetermined sequence. All (random, new, game play, or other user-defined) sequences are referred to herein as "predetermined" because the sequence of the final sorted deck is determined before any card is moved. Although the present invention can be used to sort a large variety of cards, the present discussion, for illustration purposes, will discuss the invention in the context of a stack of one or more standard decks of game cards, each card having a rank and suit printed on its face.

The automatic card sorter of the present invention includes at least one card reader for reading the characters on the face of a game card. From the input from the card reader, the controller, typically a microprocessor in conjunction with appropriate software and hardware, determines the rank and suit of the card. The controller also has sufficient memory to store a variety of information. The card reader, in an alternative embodiment, can also read identification codes (other than rank and suit information).

Having been given a stack to be sorted through an appropriate user interface, the controller provides a predetermined sequence for the cards. This predetermined sequence can be random as provided by a random number generator, the same sequence as a new deck (the "new" sequence), or game play (such as required by poker described above) predetermined sequence. An operator chooses the desired predetermined sequence, either a random sequence, "new" sequence, or game play sequence. Additional user-defined predetermined sequences could be provided for. Once the choice is made, the controller provides the predetermined sequence by retrieving the appropriate sequence from either a random number generator (when the choice is "shuffle") or memory.

The automatic sorter also includes a moveable tray having at least as many slots as cards in the stack. In the preferred embodiment, the first slot of the tray will receive the card having the value of the first position in the predetermined sequence. Hence, once the predetermined sequence is selected, each of the slots of the tray has an associated value (rank and suit) corresponding to the desired predetermined sequence. In operation, each card is read for its value. The controller then causes the tray to be moved to align the slot with the value of the read card into a position to accept the read card. The controller then causes the read card to be moved into the slot by a card feed mechanism consisting of a series of rollers in the preferred embodiment. The next card is then read, and the tray is moved to align the slot assigned to this card, which is then moved into the slot. This process is repeated until all of the cards in the stack have been placed in the tray in the predetermined sequence. The tray is then rapidly spun so that the cards are removed from the tray to form a sorted stack with the cards in the predetermined sequence, which can then be removed.

The random number generator, when the random mode (or "shuffle") for the predetermined sequence is selected, assures that the shuffled deck is random. Preferably, a random number generator such as that currently used in electronic poker machines and that has been approved by a gaming commission is used, so no additional gaming commission approvals will be required. The electronic random number generator and subsequent sorting into the sequence generated provides a degree of randomness that is beyond the capability of mechanical processes and is universally approved by gaming commissions. By reading the cards as they are sorted into the electronically generated random sequence, the randomness can be demonstrated by comparing the sequence of the cards in the stack after the shuffle to the generated random number as well as to the original unsorted stack.

As stated above, one reason that mechanical shufflers and human dealers fail to achieve randomness is that several cards are often moved together and may remain adjacent through several shuffles ("riffles"). The prior art shufflers cannot detect when multiple cards have been moved, so the possibility is always present that several cards could remain together through out a shuffle. The preferred embodiment of the automatic card sorter counts each card as it is read. When a smaller number of cards is counted, the possibility exists that the sorter mistakenly moved two or more cards at once into the same slot of the tray. While the tray and mechanism for moving the cards have been designed to move only one card at a time, the sorter further assures this result by counting the cards read. If fewer than the expected number of cards is counted, the automatic card sorter will alert the operator by appropriate output means, and the stack can be removed and replaced.

Because each card in the stack is read, the controller can store in memory the sequence of the original stack of cards as well as count the cards in the stack. By counting and reading the cards, the present invention verifies that the correct number of cards having proper rank and suit is present, thereby alleviating the possibility that cards have been removed, added, or substituted (i.e., replacing "5's" with face cards) during previous play. Once the operator inputs the number of decks present in the stack, the sorter can recall from memory the correct number of each rank and suit that should be present in the stack. While reading the cards in the stack, the controller can keep track of the cards read and alert the operator through appropriate output means of the low or high count. If fewer or more than a certain suit or rank are found, the controller alerts the operator through appropriate output devices that the stack has been subjected to tampering thus verifying the integrity of the deck and eliminating one of the favorite methods of card cheats.

The automatic card sorter of the present invention also eliminates wear to the surface of the playing cards. Only one "pass" is required in contrast to the many "riffles" used by human dealers or multiple shuffles required by mechanical shufflers imitating human motions. The automatic card sorter moves each card only once achieving true randomness, whereas the prior art methods require several movements resulting in greater wear while not achieving complete randomness. When such randomness is predetermined by a computer and achieved by reading and then relocating the card, the wear on the card surface is reduced accordingly because only one movement of each card per shuffle is required, whereas with a dealer or mechanical devices, several "riffles" are often conducted in an attempt to achieve randomness.

An additional advantage of the automatic card sorter over the prior art mechanical shufflers is that it can store in memory a series of predetermined sequences. This series could be recalled later to show, for example, the sequence of every sleeve or stack dealt at a given table where the automatic card sorter is installed. This information, when combined with other devices that keep track of the players at a gaming table and the hands dealt to those players, could be used to verify the winning hands at the table.

Thus, a single device is provided that is compact, can be mounted on a gaming table, and requires little operator skill or training. To operate, the operator simply places a stack of cards in a deck holding area, through which the cards are presented to the card reader (or read heads), inputs the number of decks in the stack, and selects the desired predetermined sequence. The tray and card feed mechanism are enclosed thereby shielding the entire sort from the view of the players and dealer. Thus, the present invention provides a single device and process capable of sorting into a random, new, game play, or other predetermined sequence that, in the preferred embodiment, is fast and free of annoying sounds or vibrations.

SUMMARY OF THE INVENTION

The present invention provides an apparatus and method to quickly sort a plurality of game cards in a stack into either a random, new, game play, or other user-defined predetermined sequence. The present invention is particularly well suited to be used at gaming tables for common games of chance such as poker or blackjack, which use one or more decks of fifty-two game cards, each card having a value (as used herein with respect to game cards, "value" refers to a particular combination of rank and suit, e.g., ten of diamonds) printed as characters on its face. The preferred embodiment of the apparatus provides a deck holding area in which the plurality of game cards is held for presenting a game card to at least one read head for reading the characters on the face of the presented game card. The apparatus also has a tray having a sequence of slots, the tray having at least as many slots as number of cards in the plurality of game cards. The apparatus also includes a card moving mechanism for moving the presented game card from the deck holding area into one of the slots of the tray. The tray is connected to a tray positioning mechanism for selectively positioning the tray to receive a game card in one of the slots of the tray from the card moving mechanism. A controller is connected to the read head, the card moving mechanism, and the tray positioning mechanism. The controller controls the reading of each of the plurality of game cards by the read head and identifies the value of each read card. The controller also controls the card moving mechanism to move each of the plurality of cards to a slot of the tray positioned by the tray positioning mechanism according to the predetermined sequence of values to receive a card from the card moving mechanism.

The present invention also includes a method for sorting a plurality of game cards, each game card having a face with characters indicating a value, into a predetermined sequence. A step of the preferred embodiment of the method includes providing a tray having a sequence of slots, the tray having at least as many slots as number of game cards in the plurality of game cards. The preferred embodiment also includes determining a predetermined sequence of values for the plurality of game cards, and reading the face of a game card of the plurality of game cards to determine the value the game card. The method further includes moving the read game card into one of the plurality of slots of the tray. The position of the slot into which the read game card is moved corresponds to the position of the value in the predetermined sequence. The next game card is then read, and the above steps repeated until all of the plurality of game cards in the stack have been read and moved into the tray. Where more than one deck exists in the stack, the automatic card sorter determines an optimum path to an appropriate slot (as there would be more than one slot or position for any given value) in order to reduce the time required for a sort.

Many other embodiments are included within the claims of the present invention, several of which are discussed below. Numerous other features, objects, and advantages of the invention will be apparent from the following description when read together with the accompanying drawings.

BRIEF DESCRIPTION OF THE DRAWINGS

The present invention can be more readily understood in conjunction with the accompanying drawings in which.

DETAILED DESCRIPTION OF THE INVENTION

1. Overview

Figure 1A:
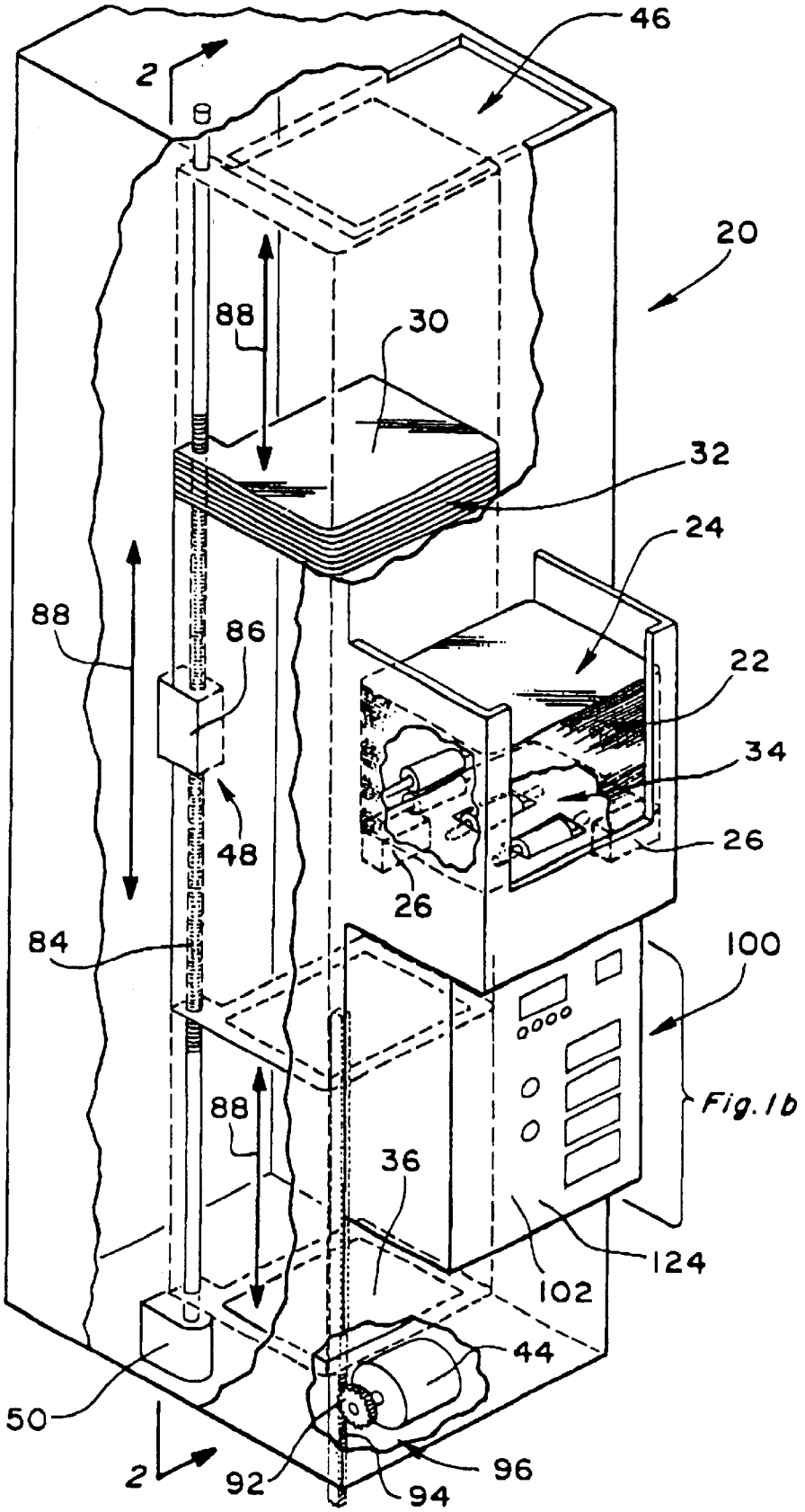
FIG. 1*a* shows a perspective view of a preferred embodiment of the automatic card sorter of the present invention.
Figures 5A, 5B, 5C, 5D:
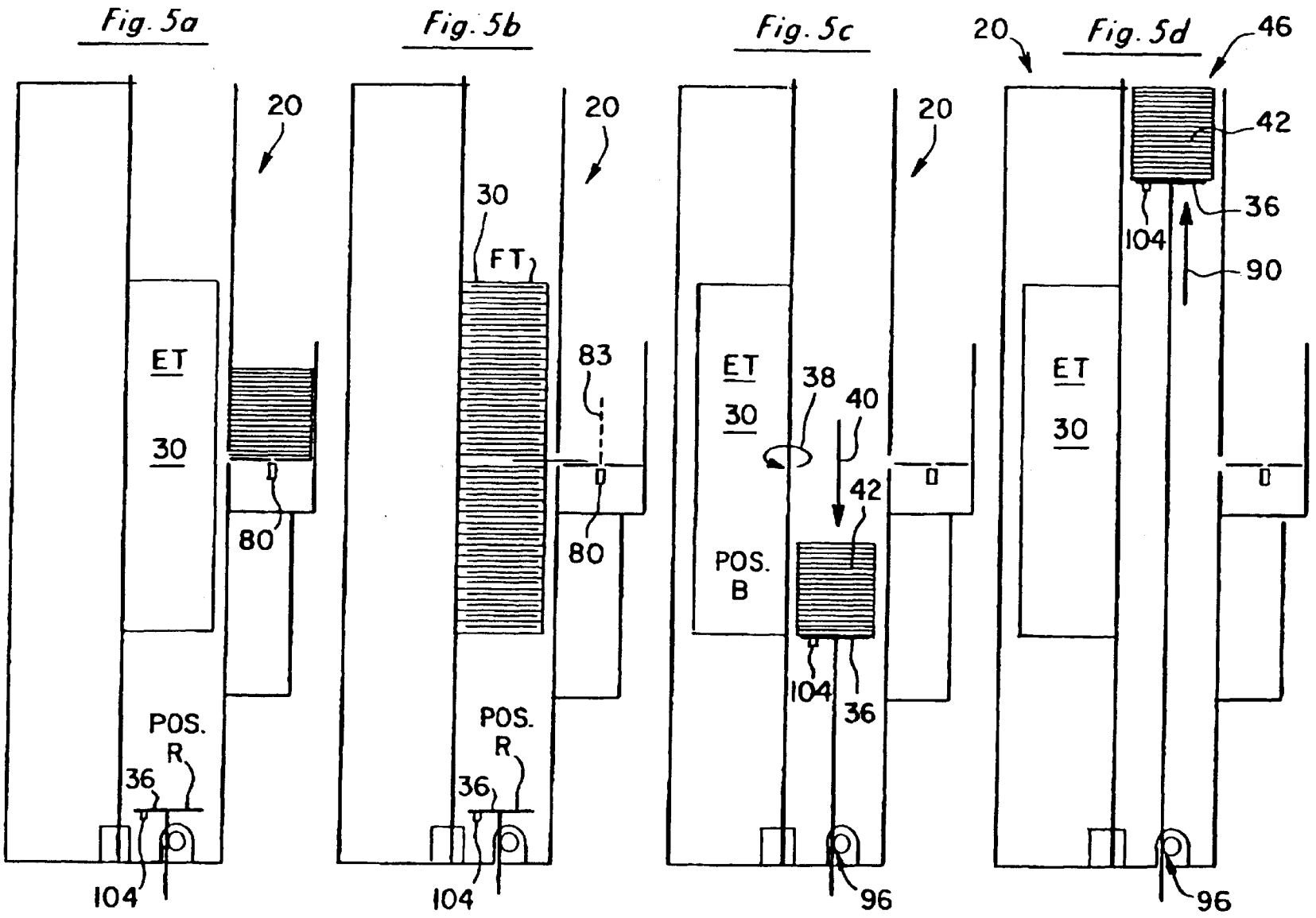
FIG. 5*a* shows an empty tray of the automatic card sorter shown in FIG. 1*a* poised to receive a first card.
FIG. 5*b* shows the tray of the automatic card sorter of FIG. 1*a* receiving the last card to be sorted.
FIG. 5*c* shows the tray of the automatic card sorter of FIG. 1*a* being rapidly spun to remove a plurality of cards (shown falling 40 to a platform)
FIG. 5*d* shows a sorted deck of cards resting on the platform being lifted 90 for removal from the automatic card sorter of FIG. 1*a;*

FIG. 1*a* shows a preferred embodiment of the automatic card sorter 20 of the present invention. A stack containing a plurality of game cards 22 are presented to the deck holding area 24. Each game card 22 has a conventional face with markings indicating rank and suit. The plurality of game cards 22 are presented in a face down orientation so as to align the graphical markings indicating rank and suit with the read heads 26 (also shown in FIG. 3). The automatic card sorter 20 has a tray 30 having a plurality of slots 32 for receiving cards 22. A predetermined sequence is selected by the controller 100 based upon the input from the control panel 102. A bottom card 22' (shown in FIG. 2) of said plurality of cards 22 is read by the read heads 26. (It is to be expressly understood that "bottom" in "bottom card 22'" does not refer to any particular orientation, but merely refers to the first card to be read in the stack of plurality of cards 22.) The output from the read heads 26 is processed by the controller 100 to identify the bottom card 22' by rank and suit. The rank and suit information is passed to the controller 100 and associated hardware where this information is processed and stored. The tray 30 is caused to align by a tray positioning mechanism 48 to receive the bottom card 22' of the plurality of game cards 22 in a slot 32 corresponding to the position of the value of the bottom card 22 in the predetermined sequence. A card feed mechanism 34 moves the bottom card 22' of said plurality of game cards 22 into an appropriate slot 32. This process is repeated until the deck holding area 24 is empty and all cards 22 have been repositioned to a predetermined sequence in the tray 30. When the final card has been moved to the tray 30, the tray 30 is caused to spin 38 (shown in FIGS. 2 and 3) by a motor 50. This causes the cards 22 to fall 40 (as shown in FIG. 5*c*) to a card removal platform 36 forming a sorted deck 42 (shown in FIG. 5*c*). Once this as occurred, a platform motor 44 is activated raising 45 (FIG. 2) the platform 36 and the sorted deck 42 to the deck removal area 46 (as shown in FIG. 5*d*).

2. Detailed Description of the Card Feed Mechanism

Figure 1B:
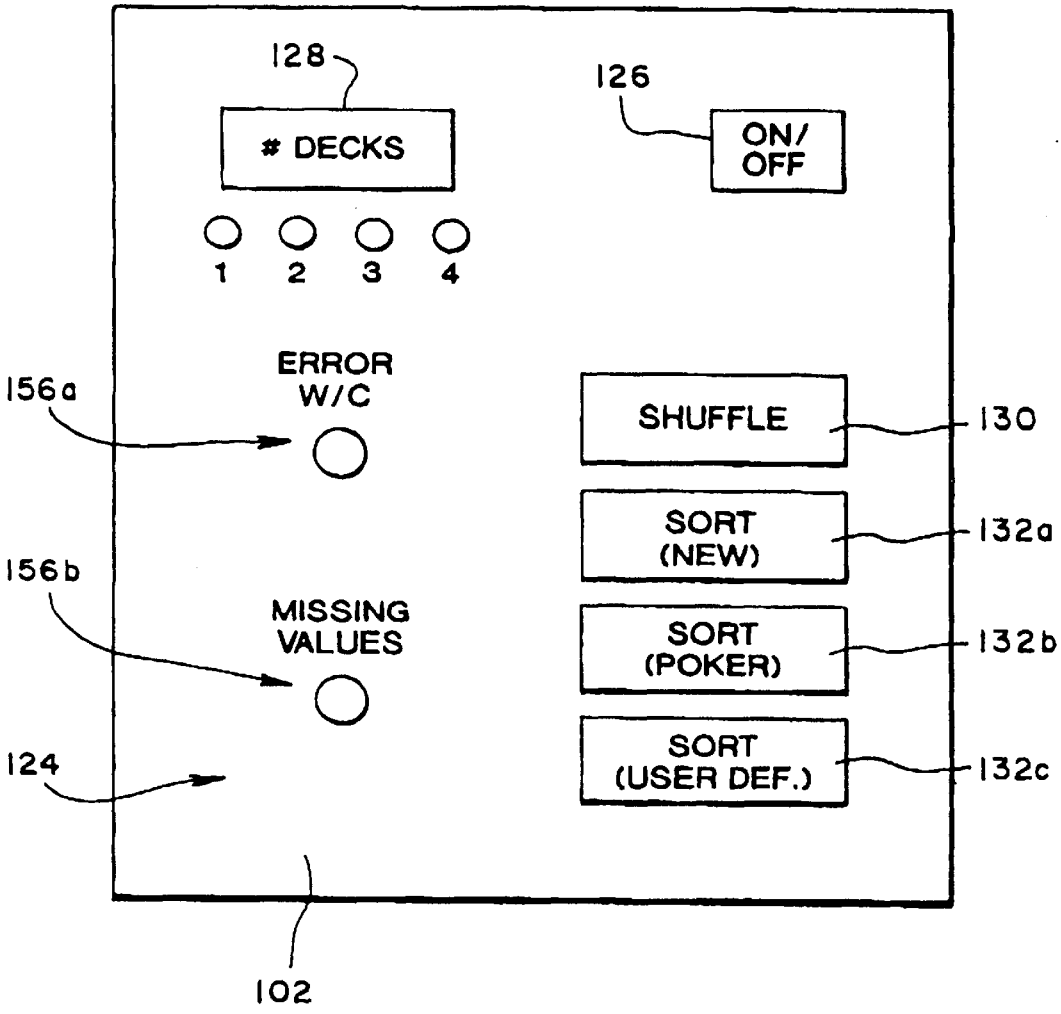
FIG. 1*b* shows the control panel of the preferred embodiment shown in FIG. 1*a;*
Figure 2:
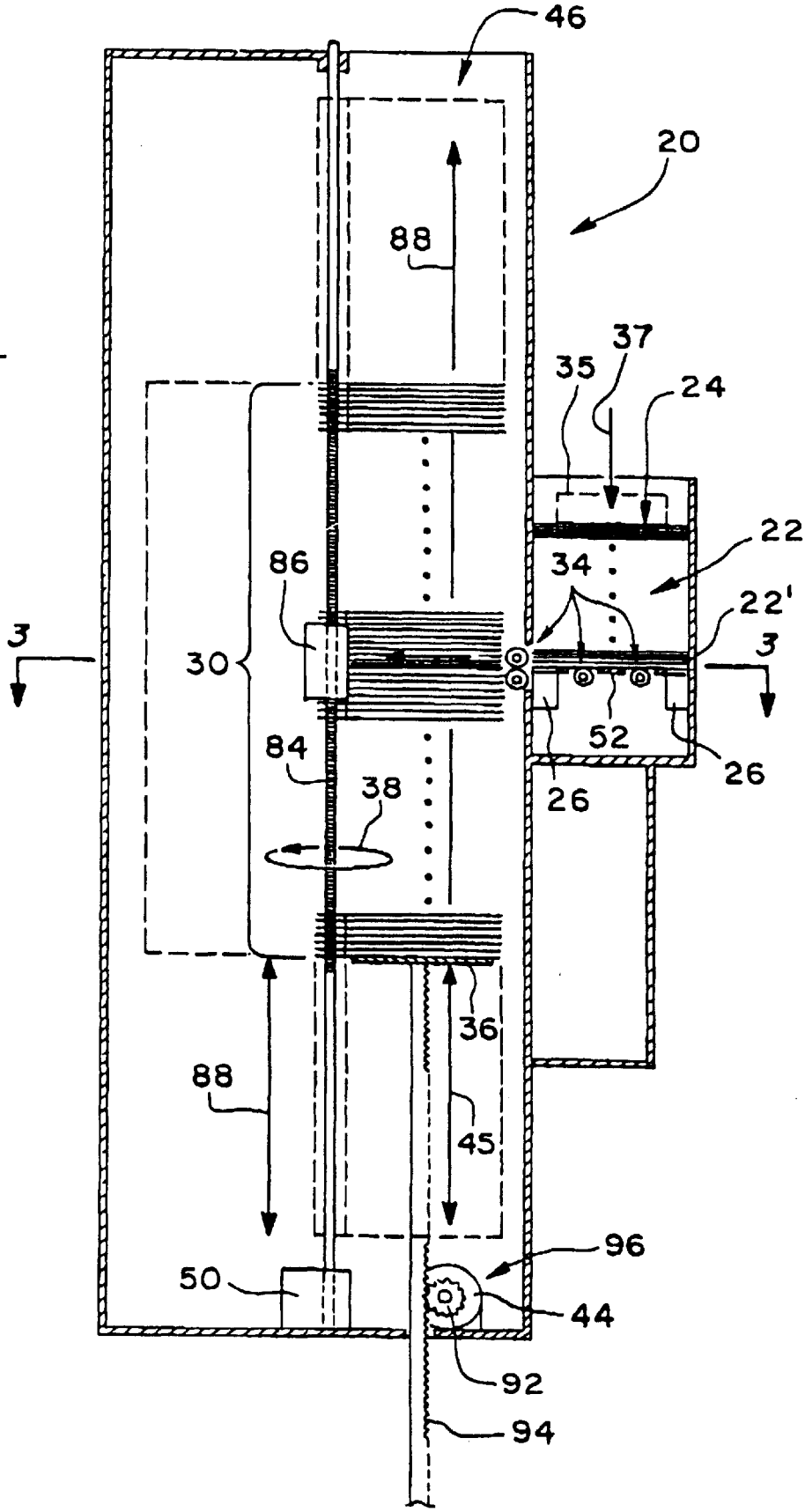
FIG. 2 is a cross-sectional view of the automatic card sorter shown in FIG. 1*a;*
Figure 3:
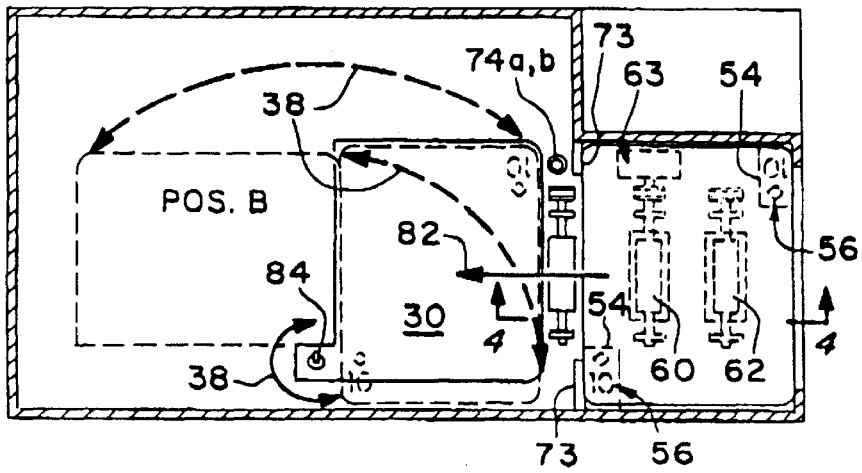
FIG. 3 is a cross-sectional view taken along line 3 of FIG. 2.

As more clearly shown in FIG. 2, a plurality of game cards 22 are presented in a face down orientation in the deck holding area 24 consisting of a rectangular area (as shown in FIG. 1) slightly larger than the area of the game cards 22. The deck holding area 24 has a bottom support surface 52 (shown in FIGS. 2 and 4) to partially support the plurality of game cards 22. The automatic card sorter 20 has at least one read head 26, and preferably two read heads 26, for reading the characters 56 on the face of the bottom game card 22'. One read head 26 would suffice, but using two read heads 26 ensures greater accuracy in reading the cards 22. As shown in FIG. 1, the read heads 26 are positioned at opposite corners of the deck holding area 24, the corners corresponding to the corners on which the rank and suit characters 56 appear on the game cards 22 as shown in FIG. 3 (where a game card is shown face down). The bottom support surface 52 has openings 54 (shown as dashed lines in FIG. 3) to allow the read heads 26 to view the characters 56 of the bottom game card 22'. The bottom surface 52 also has openings 58 (shown in FIG. 4*a*–4*d*) for a card feed mechanism 34.

The card feed mechanism 34 of the preferred embodiment 20 is more clearly shown in FIGS. 4*a*–4*d*. The card feed mechanism 34 is comprised of a free spinning roller 60, a powered roller 62, and a pair of constantly spinning rollers 64. The powered roller 62 has two modes of operation: in the first it is rotated by appropriate means, such as an electric motor 63 (FIG. 3), to apply a force on the bottom card 22'; in the second mode, the powered roller 62 is not powered, but freely spins. Preferably, these two modes of operation can be achieved by simply turning the motor 63 (shown in FIG. 3) connected to the powered roller 62 "on" and "off" where in the "off" mode, the motor 63 simply spins. Alternatively, these two modes can be achieved by an electrically controlled clutch connecting the powered roller 62 to appropriate power means, such as an electric, pneumatic, or other motor. The powered roller 62 and free spinning roller 60 project above the bottom support surface 52 so that the bottom card 22' of the plurality of cards 22 rests primarily on the surface of these two rollers 62, 60. Because the cards 22 are flexible, the bottom card 22' may contact the bottom support surface 52 as well as the rollers 62,60. There is an opening 65 in the deck holding area 24 to allow passage of a single game card 22.

Figure 4A:
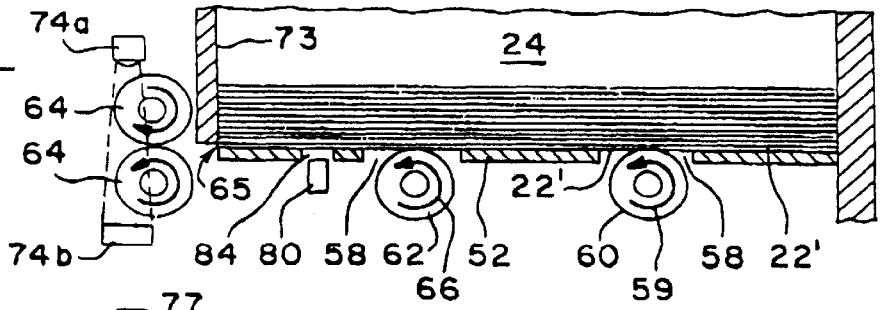
FIGS. 4*a* through 4*d* show a cross-sectional view taken along line 4 of FIG. 3 showing the operation of the card feed mechanism of the automatic card sorter shown in FIG. 1*a;*
Figure 4B:
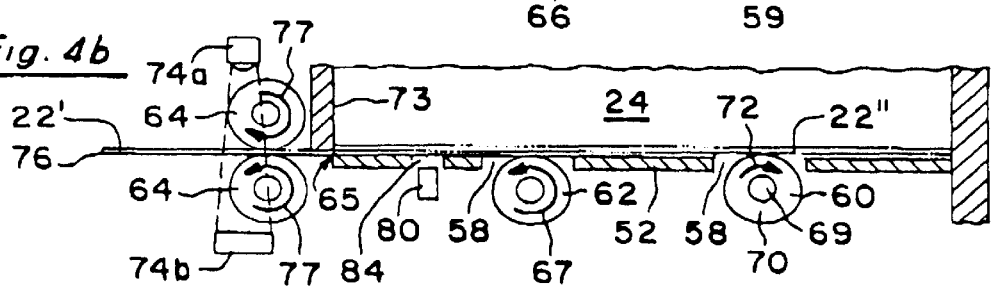

FIGS. 4*a*–4*b* illustrate the operation of the card feed mechanism. As shown in FIG. 4*a*, the bottom card 22' of the plurality of game cards 22 held in the deck holding area 24 initially rests on the rollers 60, 62. To begin a sort, the powered roller 62, which can be driven by an electric motor 63 (shown in FIG. 3) or other drive means, is rotated 66 causing the bottom card 22' to move to the position shown in FIG. 4*b*. The friction between the bottom card 22' and the free spinning roller 60 causes the free spinning roller 60 to rotate 59 in the same direction as the powered roller 62. As the card 22' moves out of the deck holding area 24 (as shown in FIG. 4*b*), the free spinning roller 60 ceases to contact the bottom card 22', and contacts the next card 22". The free spinning roller 60 has a shaft portion 69 and a roller portion 70. Although the free spinning roller 60 can freely spin, the roller 60 is selected so that there is a degree of friction between the roller portion 70 and the shaft portion 69. There exists a frictional force between the two cards 22',22" tending to pull the next card 22" out of the deck holding area 24. This movement of the next card 22" is resisted by the friction between the shaft portion 69 and the roller portion 70; this friction is sufficient to cause a force on the next card 22" in the direction 72 opposite of the force imposed by the bottom card 22' on the next card 22'.

The automatic card sorter 20 has an opening 65 for the bottom card 22' and is designed to allow passage of only a single card 22. The opening 65 in this embodiment 20 is defined by the bottom support surface 52 and a wall 73. Hence, the sizing of the opening 65 and the friction within the free spinning roller 60, either alone or together, prevent the next card 22" from being pulled out of the card holding area 24 by the bottom card 22'.

As shown in FIG. 4*b*, the card feed mechanism 34 also has a sensor 74 to sense the presence of a game card 22. This sensor 74 is located after the constantly spinning rollers 64 in order to detect when the bottom game card 22' has engaged the constantly spinning rollers 64. In the preferred embodiment, the sensor 74 is comprised of an emitter 74*a* for emitting light, such as an LED, and a receiver 74*b* to receive the light from the emitter 74*a*. The receiver produces an output signal that varies with presence or absence of light from the emitter 74*a* .

Figure 4C:
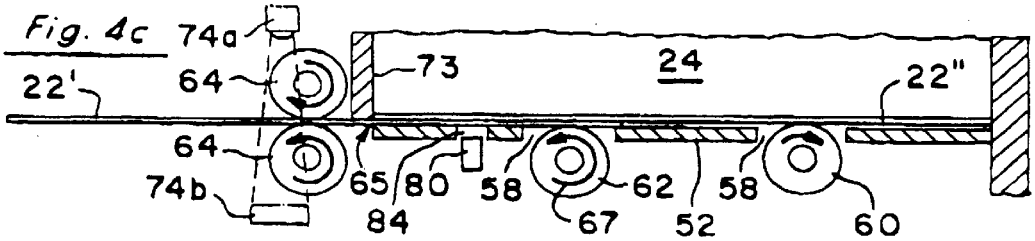

As shown in FIG. 4*b*, the bottom card 22' is urged into the opening 65 by the powered roller 62. The constantly spinning rollers 64 counter-rotate 77 as shown to quickly pull the bottom card 22' out of the deck holding area 24. A small space exists between the constantly spinning rollers 64 to allow a single card 22 to pass; however, rollers 64 are spaced closely together so that sufficient pressure exists between the bottom card 22' and rollers 64 to generate sufficient frictional forces to overcome any forces tending to hold the bottom card 22' in the deck holding area 24. The constantly spinning rollers 64 spin rapidly 77 to quickly accelerate and rapidly move the bottom card 22' into the appropriate slot 32 of the tray 30. As the leading edge 76 of the bottom card 22' emerges from between the constantly spinning rollers 64, the sensor 74 detects the leading edge 76 as the bottom card 22' blocks the light from the emitter 74*a* causing the receiver 74*b* to produce an output signal. Thus, the card is detected, and the controller 100 (to be described below) receives this output from the sensor 74 and causes the powered roller 62 to cease applying power and to freely spin as the bottom card 22' emerges from between the constantly spinning rollers 64. However, as shown in FIGS. 4*b* and 4*c*, the powered roller 62 will continue to freely spin 67 in the direction of movement 82 (FIG. 3) of the bottom card 22'.

Figure 4D:
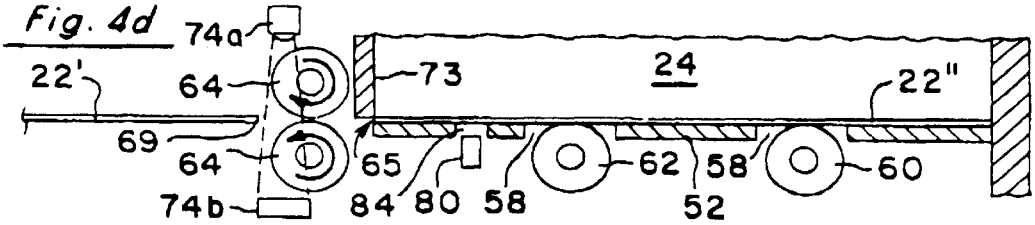

As shown in FIG. 4*d*, the bottom card 22' has been moved completely out of the deck holding area 24 into the tray 30. The receiver 74*b* again receives light from the emitter 74*a* when the following edge 69 of the bottom card 22' passes. Thus, the sensor 74 also senses that the movement 82 of the bottom card 22' into the tray 30 is complete (by sensing the following edge 69 of the bottom card 22'). The powered roller 62 and the freely spinning roller 60 both contact the next card 22" and remain stationary until the powered roller 62 is switched to its powered mode by the controller 100 (to be described below). In this manner, the card feed mechanism 34 can be used to sequentially move all of the plurality of game cards 22 out of the deck holding area 24 into the tray 30 (as shown in FIGS. 3, 5*a*–5*d*).

As shown in FIGS. 4*a*–4*d* and FIG. 5*b*, the deck holding area 24 has a sensor 80 to sense when the last card of the plurality of cards 22 has been moved out of the deck holding area 24. In the preferred embodiment, the sensor 80 is solid state device that senses the presence of ambient light 83 (FIG. 5*b*) coming through an opening 84 in the bottom support surface 52. When the cards 22 are present, the ambient light is blocked.

In the preferred embodiment, the weight 37 (shown in FIG. 2) of the cards alone, whether the entire stack or a single card, is sufficient to cause adequate friction between the rollers 60, 62 and the bottom card 22' for proper operation of the card feed mechanism 34. However, in another embodiment, a spring loaded arm or a weight 35 (shown in FIG. 2) could be placed on the top card of the plurality of cards 22 once the plurality 22 is placed in the card holding area 24 to provide additional downward pressure 37. In this instance, the sensor 80 could be an electrical contact type placed in a position to contact the spring loaded arm or weight, which would be grounded, after all of the cards 22 are removed, and such contact would complete an electrical circuit to provide an output signal to the controller 100 indicating that all of the cards 22 had been removed.

3. Detailed Description of the Tray Positioning Mechanism

As set forth above and explained in further detail below, the card feed mechanism 34 moves the plurality of cards 22 into the tray 30. In order to sort the cards 22 into a predetermined sequence, the tray must be precisely positionable so that each of the slots 32 can be aligned with the opening 65 (shown in FIGS. 4*a*–4*d*) to receive a single card of said plurality of game cards 22. This is accomplished by the tray positioning mechanism 48 (shown in FIG. 1*a*), which includes, in addition to the tray 30, a threaded rod 84 and a tray positioning motor 86, which in the preferred embodiment is an electric stepper motor 86. Electric stepper motors typically having a central rotor. In this preferred embodiment 20, the threaded rod 84 remains stationary in the tray positioning phase of operation, and the central rotor of the electric stepper motor 86 has a threaded interior that mates with the threads of the threaded rod 84. The tray 30 is mounted to the electric stepper motor 86. Such motors are built to precisely rotate a specific number of steps in one revolution, and also typically rotate in half steps. By well known conventional control software and circuitry, the tray 30 can be precisely positioned along 88 the threaded rod 84 by the electric stepper motor 86. With such stepper motors, closed loop positioning feedback is unnecessary, although position sensors located alongside the threaded rod 84 may be desirable for use in the calibrating the tray positioning mechanism 48 from time to time.

Many other mechanisms could be used within the scope of this invention. For instance, a more conventional mechanism would include a threaded rod turned by an electric stepper motor. However, in this alternate configuration, the housing of the motor would remain stationary, and the rotation of the rotor would turn the threaded rod. The tray would be mounted to the rod by a block with internal threads engaging the external threads of the rod. The turning of the rod would drive the block along the rod. In yet another embodiment, analog DC motors could be used in combination with closed lop feedback in place of the stepper motors mentioned above.

4. Detailed Description of Card Removal Mechanism

Once the plurality of cards 22 have been placed in the tray 30 (as shown in FIG. 5*b*), it is desirable to remove the cards 22 from the tray 30 without disturbing the sequence of the cards 22. Referring to FIG. 1*a*, although many means are available, the preferred embodiment 20 utilizes the card removal motor 50 attached to the threaded rod 84. When the sensor 80 detects that all of the cards 22 have been moved out of the deck holding area 24, and the sensor 74 indicates that the last card 22 has passed through the constantly spinning rollers 64, the controller 100 (described below) activates the motor 50 to rapidly spin 38 the tray 30 ninety degrees as shown in FIG. 3 to Position B (also shown in FIG. 5*c*). Due to the rapidity of the spinning motion and the mass (exhibiting inertia) of the cards 22, the cards 22 momentarily stay in their respective positions before falling 40 (shown in FIG. 5*c*) to the platform 36 forming a sorted deck 42. While sorting the cards 22, the platform 36 is lowered 45 (FIG. 2) to a rest Position R as shown in FIGS. 5*a* and 5*b*. Just before the tray 30 is spun 38 but after the last card 22 has been moved into the tray 30, the platform 36 is raised 45 to a higher position shown in FIG. 5*c* just below the tray 30 so that the cards 22 have less distance to fall 40 after the spinning 38 of the tray 30. The platform 36 is then raised 90 (FIG. 5*d*) by a platform raising mechanism 96, which in this preferred embodiment 20 includes a platform motor 44, a pinion 92, and a rack 94 (referring to FIG. 1*a*), to a deck removal area 46 where the sorted deck 42 (shown in FIG. 5*d*) can be removed.

On the bottom of the platform 36 (as shown in FIGS. 5*a*–5*d*) is a removal sensor 104 to sense when the sorted deck 42 has been removed from the platform 36. The removal sensor 104 can be a contact switch, a pressure sensor, or a light sensitive diode that is initially covered by the sorted deck 42 and senses the ambient light when the deck 42 is removed. Upon sensing through the removal sensor 104 that the sorted deck 42 has been removed, the controller 100 (described below) causes the platform 36 to be lowered to Position R (shown in FIG. 5*a*) and the tray 30 to be returned to its original position (away from Position B as shown in FIG. 5*a*).

5. Detailed Description of the Controller of the Preferred Embodiment

Figure 6:
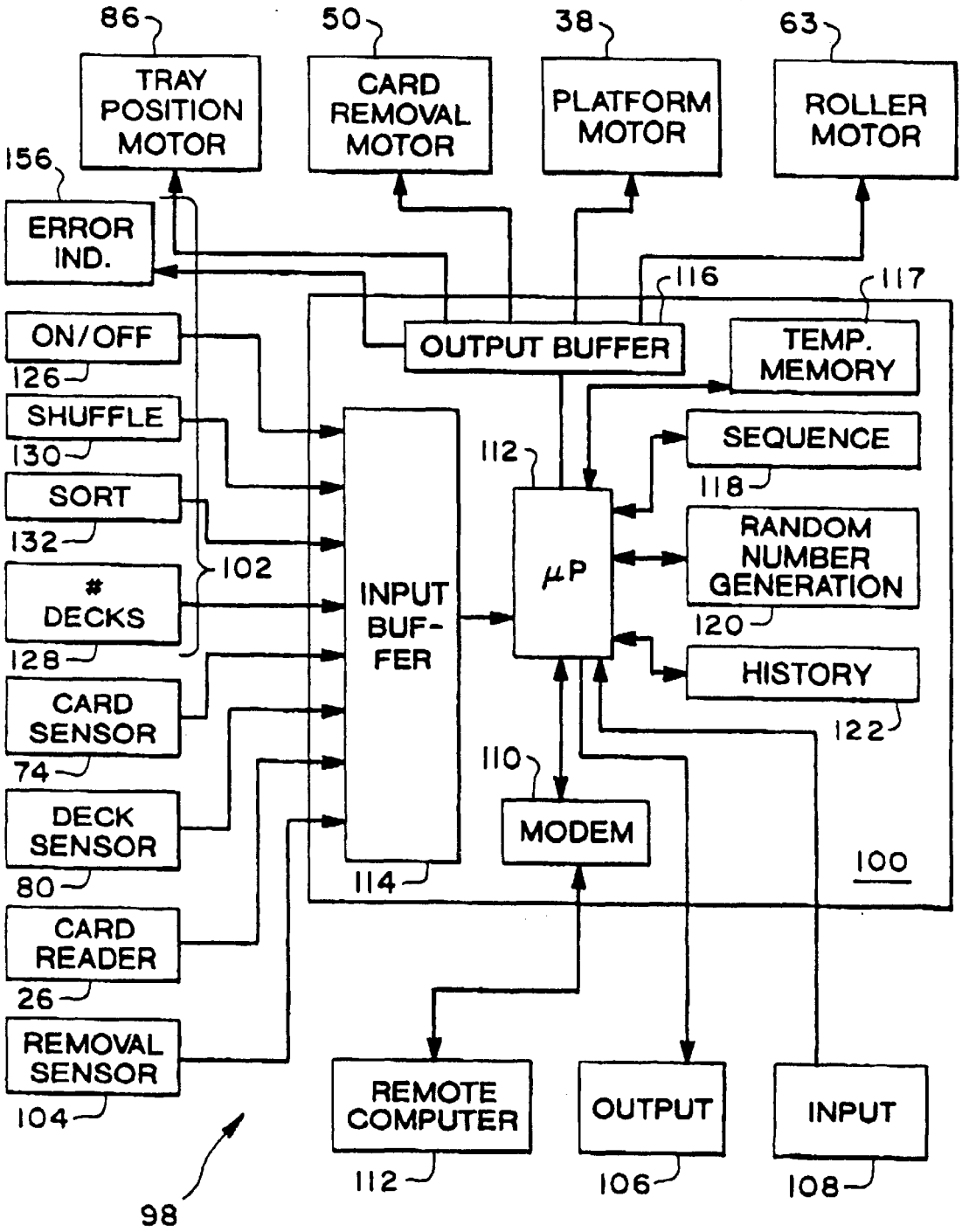
FIG. 6 shows an electrical schematic illustrating the components used in the automatic card sorter of FIG. 1*a;*

Control is provided for the automatic card sorter 20 by the electronic control circuit 98 shown in FIG. 6. As shown in FIG. 6, the electronic control circuit 98 consists of a controller 100 connected to the various actuating means (motors 86, 50, 38, and 63), a control panel 102, various sensors (74, 80, 104), and the card read heads 26 (also known as the "card reader"). The control panel 102 includes the following input and output means: error indicator 156, on/off switch 126, shuffle switch 130, sort switch 132, and "No. of Decks" switch 128. The controller 100 has at least one additional output port 106 and input port 108 for communicating with other optional devices. The controller 100 also includes a modem 110 for communicating with other remote computers 112. The modem 110 can be an internal modem as shown, or an external modem connected through a port.

The controller 100 includes a microprocessor 112, an input buffer 114, an output buffer 116, memory 118 to store various sequences, a random number generator 120, which maybe a discrete device or a software program stored in memory, history memory 122 for storing a series of sequences both before and after a sort, and temporary memory 117 for general purpose use during the sorting process. The controller 100 can be mounted within a housing 124 below the deck holding area 24 as shown in FIG. 1*a* with the control panel 102 located on the surface of the housing 124.

6. Operation of the Automatic Card Sorter and the Preferred Embodiment of the Method for Sorting The preferred embodiment of the automatic card sorter 20 described above can be used to implement the below described preferred embodiment (shown in FIG. 7) of the method for sorting a stack of game cards into a random, "new", game play, or other predetermined sequence such as defined by the user. Note that a random predetermined sequence may also be referred to as a "shuffle".

To start, the on/off button 126 (shown in FIG. 1*b*) is selected 134 (FIG. 7) on the control panel 102 to activate the automatic card sorter 20. A stack having a plurality of game cards 22 is placed in the deck holding area 24 of the automatic card sorter 20. The preferred embodiment 20 is designed to hold as many as four decks each having fifty-two cards, although the design disclosed herein could easily be modified to accommodate a larger number such as six decks or a smaller number such as one deck. The deck sensor 80 senses the presence of the plurality of cards 22 in the deck holding area 24. The microprocessor 112, being activated by the on/off button 126, receives the input from the deck sensor 80 through the input buffer 114, and in response, waits further input of the number of decks and the type of sequence desired by the user. The user enters the number of decks 136 (FIG. 7) in the deck holding area 24 through the input switch 128, which in this preferred embodiment toggles between 1, 2, 3, and 4, which are indicated by LED displays 130 as shown in FIG. 1*b*. Obviously there are many other input devices that could be used, such as a numeric keypad.

The user then selects 138 (FIG. 7) the sequence. With the preferred embodiment 20, there are four predetermined sequences from which to choose. The first is a shuffle having a random sequence, which is chosen by pressing an input switch 130 (marked "shuffle" in FIG. 1*b*). The second is to sort the plurality cards 22 into the sequence of a standard "new" deck of cards. This choice can be made by pressing the input switch 132*a* as shown in the control panel 102 in FIG. 1*b*. The third is to sort the plurality into the game play sequence such as that required by poker, which (as described above) is spades, hearts, clubs, and diamonds. This choice can be made by pressing the input switch 132*b* as shown in FIG. 1. At least a fourth user defined choice is provided by input switch 132*c*. It is anticipated that any number of user defined sequences could be provided by storing such sequences in memory 118, and providing appropriate input means such as input switch 132*c* for the user to select such sequences. Discrete switches could be provided for each choice, as shown by switches 130, 132*a*, 132*b*, and 132*c* shown in FIG. 1, or a toggle (four position) switch such as switch 128, or an alpha-numeric keypad could also be used. Regardless of the specific input means, the microprocessor 112 receives the selected type of predetermined sequence through the input buffer 114. It is to be understood that an automatic sorter, under the teachings of the present invention, could be designed for only one sequence (e.g., shuffle or new sort) thereby eliminating the switches and associated control.

The next step is for the microprocessor to get 140 the sequence selected by the user. If shuffle 130 was selected, the microprocessor 112 will utilize a random number generator 120 to arrive at a random sequence for the plurality of game cards 22. In the preferred embodiment 20, the random number generator 120 is a discrete device such as those commercially available and already approved by a gaming commission. However, the random number generator 120 could also be a software program residing in memory, such programs being well known. The random sequence generated, referred to as a "predetermined" sequence since the sequence is determined before any one of the plurality of cards 22 is moved, is then stored in temporary memory 117. If the "new" sequence, game play sequence, or other user-defined, predetermined sequence was chosen, the microprocessor 112 will get 140 the sequence by referring to memory 118 to retrieve the specified predetermined sequence, which will have been previously stored.

Figure 7:
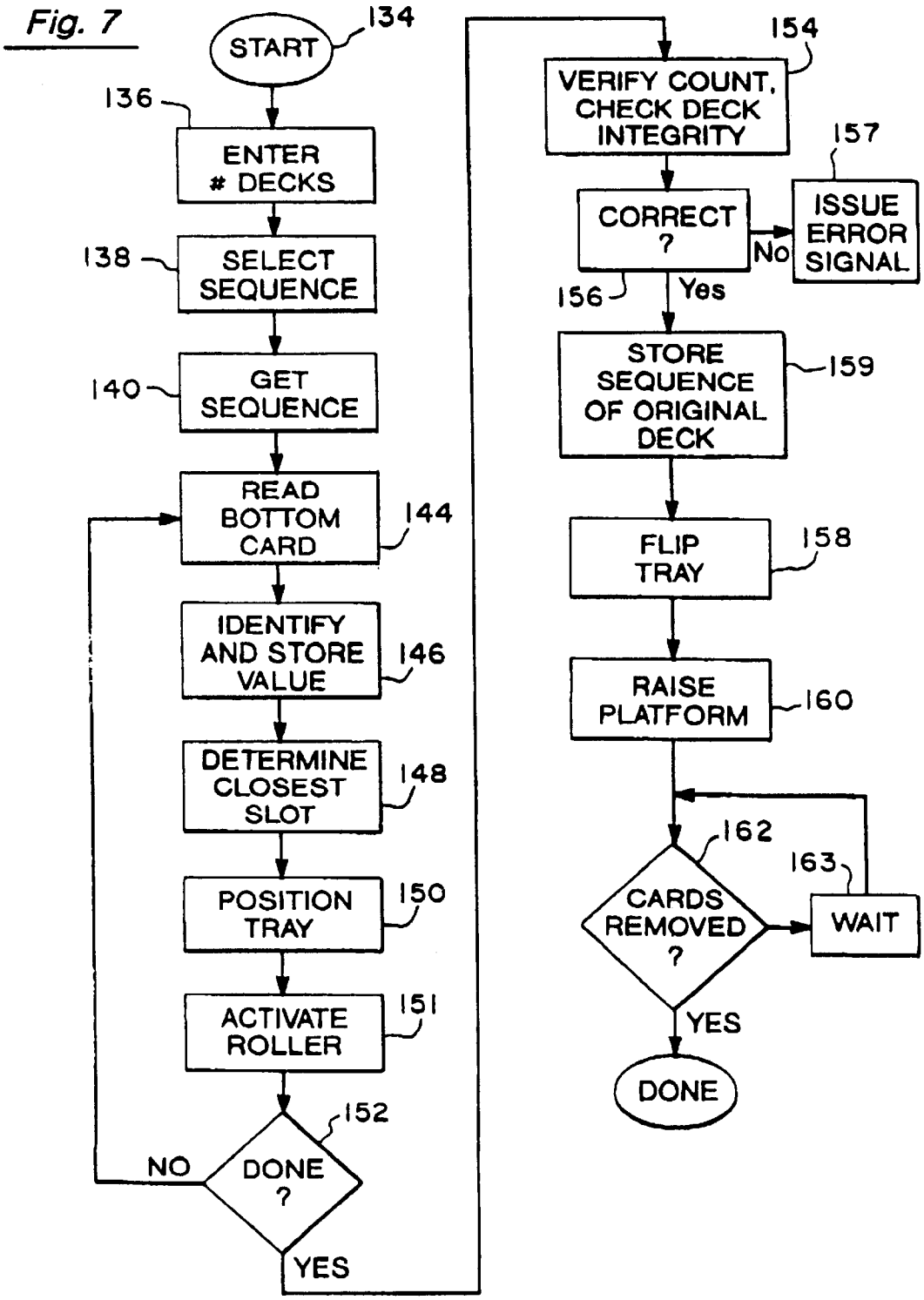
FIG. 7 shows the flow chart of the preferred embodiment of a method of the present invention for automatically sorting a plurality of game cards in a stack.
Figure 8:
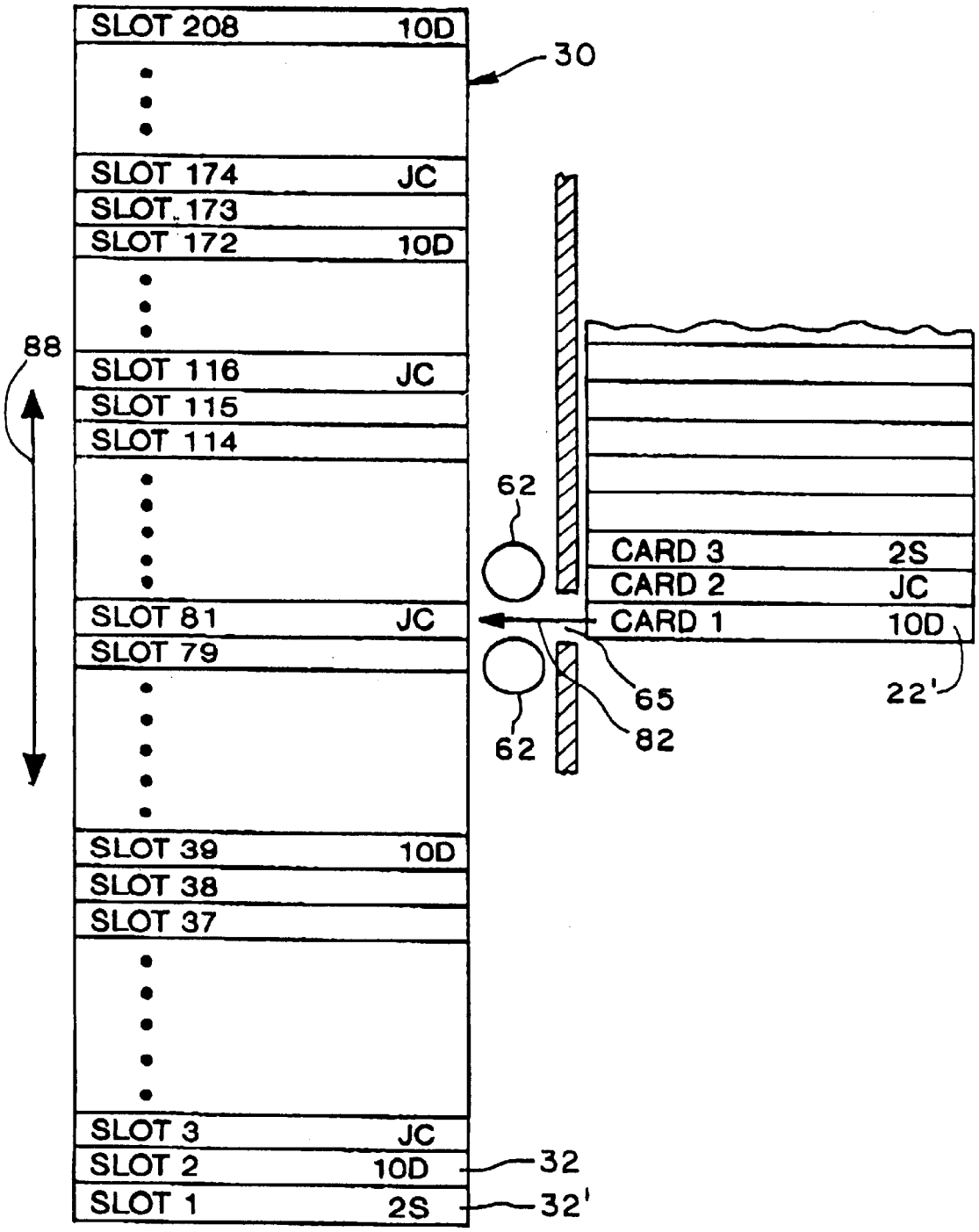
FIG. 8 further illustrates the preferred embodiment of the sorting method of the present invention as implemented by the automatic card sorter shown in FIG. 1*a*.

The bottom card 22', or CARD 1 as shown in FIG. 8, is presented to the read heads 26 by the deck holding area 24, and is read 144 (FIG. 7). The card is identified 146 by the microprocessor 112 utilizing appropriate character recognition software in conjunction with the input received from the read heads 26. Once identified 146, the microprocessor 112 stores 146 the count (i.e., first, second, etc.) and the value (rank and suit) of the bottom card 22' in temporary memory 117.

The controller 100, through the microprocessor 112, next determines 148 (FIG. 7) the closest slot 32 of the tray 30. Once the predetermined sequence is selected, the controller 100 assigns a value to each slot 32 according to the predetermined sequence. In the preferred embodiment, the first slot 32 (SLOT 1 of FIG. 8) corresponds to the first position in the predetermined sequence. Therefore, the slots 32 of the tray 30 have a value associated with them based upon the selected predetermined sequence. For example, referring to FIG. 8, assuming that the selected predetermined sequence was a random sequence (i.e. "shuffle" was chosen), and that this sequence begins with the two of spades (abbreviated "2S"), next, the ten of diamonds ("10D"), then the jack of clubs ("JC"), and so on, ending with the ten of diamonds ("10D"). The goal of the automatic game card sorter 20 is to place the plurality of cards 22 in the tray 30 in this predetermined sequence, beginning with the first slot, SLOT 1, which will receive a two of spades (2S). Thus, the first slot has the value of "2S". Since, in this example, there are four fifty-two card decks in the plurality of cards 22, the plurality consists of two hundred eight cards 22. Therefore, there are four cards of the same rank of the same suit, (e.g., there are four ten of diamonds, as it is a four deck stack). Assume that, as illustrated in FIG. 8, the tray 30 is initially positioned with SLOT 81 positioned across from the opening 65. In order to minimize movement of the tray 30 so as to expedite the sort, the controller 100 determines 148 which slot having the same value as CARD 1 is closest to position 81 (since SLOT 81 is currently across from opening 65). In the example of FIG. 8, position 39 in the predetermined sequence is a ten of diamonds (10D). SLOT 39 is the closest slot having the value of ten of diamonds to SLOT 81. Therefore, the controller 100 causes the tray alignment mechanism 48 to position 150 SLOT 39 across from the opening 65 by sending the appropriate output signal through the output buffer 116 to the tray positioning motor 86. After determining 148 the closest slot, the controller 100 also stores in memory 117 the location of this slot (SLOT 81) so that it will not be considered again as only empty slots are considered in determining 148 the closest slot.

Once the closest slot 32 of the tray 30 has been moved across from the opening 65, the controller 100, by the microprocessor 112, activates 151 through the output buffer 116 the roller motor 63 of the card feed mechanism 34. The powered roller 62 then pulls the bottom card 22' (shown as CARD 1 in FIG. 8) out of the deck holding area 24 toward the constantly spinning rollers 64 (as shown in FIG. 4*b*). After engaging the rapidly spinning rollers 64, the bottom card 22' is rapidly propelled by the rollers 64 into a slot 32 of the tray 30. When the controller 100 receives the output signal from the card sensor 74, the controller stops the roller motor 63 so that the powered roller 62 freely spins. Because the sensor 74 senses the emitted light from the emitter 74*a* (as show in FIGS. 4*a*–4*d*), the sensor 74 actually senses both the leading 76 and following 69 edges of the bottom card 22'. Thus, when the leading edge 76 (shown in FIG. 4*b*) passes across the sensor 74, the controller 100 receives the output from the sensor 74 and causes the roller motor 63 to cease applying power and to freely spin. When the following edge 69 of the bottom card 22' (shown in FIG. 4*d*) crosses the sensor 74, the controller 100 receives the signal from the sensor 74 indicating that the receiver portion 74*b* is again exposed to the emitted light, and interprets this signal to mean that the bottom card 22' has been placed in the slot 32 across from the opening 65. The controller 100 then looks to the input from the deck sensor 80 to determine whether the sort is done 152 (FIG. 7). If not done, the next bottom card 22" is read (CARD 2 in FIG. 8), and the process (steps 144, 148, 150, 151 of FIG. 8) is repeated until the entire plurality of cards 22 has been read and sorted into the tray 30 in the selected predetermined sequence.

When the sort is done, as indicated by the absence of cards 22 in the card holding area 24 as sensed by deck sensor 80, all of cards 22 of the plurality have been placed in the predetermined sequence in the slots 32 of the tray 30, with the first slot (SLOT 1) holding a card 22 having the first value of the predetermined sequence. Throughout the sorting process, the controller 100 stores in temporary memory 117 the count as well as value of each card read so that, at the end of the sort, the original sequence of the unsorted plurality of cards 22 as well as the total number of cards read is stored in temporary memory 117. The controller verifies 154 the count by comparing the actual number of cards read to the expected number based on the input of the number of decks. For example, if the number of decks selected 136 was four, and the decks used contained fifty two cards, a total of two hundred eight cards should have been counted. The controller 100 compares the number of cards actually counted to the expected number. If not correct 156, the controller 100 alerts the operator through the error indicator 156*a* (FIG. 6, FIG. 1*b* ("w/c" indicating "wrong count")). If a card had been added resulting in a higher count, this error could also be detected during the sort, as the controller 100 would run out of positions in the predetermined sequence before all the cards 22 had been placed in the tray 30. A lower count would indicate that either one or more cards 22 had been removed or that the card feed mechanism 34 had moved more than one card 22 through the opening 65 on one or more occasions.

A favorite method of cheating in card games is to remove certain cards and add others. The resulting deck may have, for example, five ace of diamonds (in a four deck stack), but lack another card so that the total number of cards remains the same. To detect such tampering, the automatic card sorter 20 checks 154 the integrity of the plurality of cards 22. The controller 100 compares the values of the cards 22 actually read to the values expected to be read. If the correct number of cards 22 of each rank and suit are not present, the controller 100 alerts the operator by issuing 157 an error signal through the error indicator 156*b* (FIG. 1*b*, "missing values" indicator).

FIG. 1*b* is an illustration with the error indicators 156*a*, 156*b* being single LED's. More sophisticated output devices could be used. For instance, a liquid crystal display capable of displaying a large number of characters could be used to display very detailed error messages from the controller 100 such as the specific rank and suit of the missing card or cards. If the correct number and values are present, the controller 100 then stores 159 the sequence of the original deck (plurality) of cards 22 (as actually read) as well as the selected predetermined sequence in the history memory 122.

After verifying deck integrity by determining that the plurality of cards 22 (both in number and in value) is correct 156, the controller 100 then activates the platform motor 38 to raise the platform 36 from the Position R ("R" indicating "Rest") shown in FIG. 5*b* to a position slightly below the position of the tray 30 as shown in FIG. 5*c*. The controller 100 then flips 158 the tray 30 by activating the card removal motor 50 causing the tray 30 to quickly rotate 38 to Position B shown in FIG. 5*c*. Due to the mass (which exhibits inertia) of the cards 22, the cards 22 tend to momentarily remain in the position shown in FIG. 5*b* as the tray is rotated 38, and then, when the tray reaches Position B, fall 40 (FIG. 5*c*) to the platform 36 forming a sorted deck 42. The controller 100 then raises 160 the platform 36 to the deck removal area 46 (shown in FIG. 5*d*).

The controller 100 senses whether (162, FIG. 7) the sorted deck 42 has been removed from the platform 36 through the removal sensor 104. The controller 100 waits 163 (FIG. 7) for the sorted deck 42 of cards 22 to be removed. Once removed, the controller 100 lowers the platform 36 to Position R and returns the tray 30 to its original position (shown in FIG. 5*a*). The automatic card sorter 20 is then ready to sort another plurality of cards 22.

As stated previously, it is desirable to verify winning hands, especially when the stakes are high in games of chance. To assist in this, the automatic card sorter 20 stores the original sequence of the plurality of cards 22 as well as the predetermined sequence of each sorted deck 42 in the history memory 122. When combined with other devices that keep track of players at a gaming table and cards dealt to those players, a winning hand could be verified by recalling the predetermined sequence of the deck from which the winning hand was dealt, and then simulating (based on information provided by other devices) the play of the game to verify that it was possible for the alleged winner to have received the winning hand.

Also, it is desirable to verify the randomness of the shuffled decks delivered by the automatic card sorter 20 (when the "shuffle" mode was chosen). To do this, the historical data can be recalled from history memory 122 to compare one shuffled deck to another, as well as to compare shuffled decks to the original decks. Since the historical data exists in digital form, it can be manipulated and analyzed quickly by a computer to verify the randomness of the shuffled decks. Such analysis could be performed sufficiently fast to allow such verification during the play of a game at a gaming table.

7. Alternative Embodiments

A. Addition of other readers

Another favorite type of cheating in card games is to mark certain cards in the deck. Sometimes cards are marked beforehand by a card cheat, who, at the gaming table, removes cards from the deck and replaces them with his own cards of the same rank and suit but having markings. To combat this, many casinos use invisible (to the naked eye) bar codes or other invisible markings on each card, usually in ink visible only under certain types of light, such as ultraviolet light. These markings identify each card as a member of a particular deck. Readers for detecting the house (casino's) markings could be combined with the read heads 26. For example, a read head for reading bar code could be placed adjacent to the read head 26. The preferred embodiment 20 as described above only verifies that the correct number of each rank and suit are present. With the addition of other readers to detect the house markings, the automatic card sorter would also verify that no foreign cards have been added to the deck.

B. Other positioning mechanisms

It is expected that many mechanisms for tray positioning will be obvious to one skilled in the art in light of the teachings of this disclosure. For example, instead of using the threaded rod 84, a sprocket and chain could be used. The tray 30 would then be attached to the chain driven by a motor. Also, a pinion-rack mechanism like that used to lift the platform 36 could be used in place of the threaded rod 84 and motor 86. Conversely, the pinion-rack mechanism of the platform raising mechanism 96 could be replaced by a sprocket-chain assembly or a threaded rod/motor assembly such as described for the tray positioning mechanism 48.

In order to reduce the height of the sorter 20, two trays could be used, one on each side of the deck holding area 24. Half of the deck would be sorted into each tray. The card feed mechanism 34 could easily be modified to feed cards in two directions. The two stacks contained in the trays would be combined, after the sort, either automatically or by the operator at the deck removal area 46.

Furthermore, while in the preferred embodiment the plurality of cards 22 and card feed mechanism 34 remain stationary while the tray 30 is moved, an automatic card sorter could be designed where the opposite was true. That is, the tray 30 could remain stationary, and a mechanism for moving the plurality of cards 22 and a card feed mechanism would be included. Such a device would also fall within the scope of the present invention.

C. Miscellaneous

While the above discussion has been in the context of gaming cards, having a rank and suit, the apparatus and method of the present invention could be used to sort either types of cards. For instance, some games are played with cards having only numbers, but no suits. In this case, the "value" of the card would only be comprised of the numeric value. Alternatively, gaming cards could be used baring only pictures indicating value, and no numbers. Regardless, the present invention can be used to sort any plurality of cards, each card having some value associated with it as indicated by characters on its face, into a predetermined sequence.

Only a few of the many possible variations within the scope of this invention have been discussed. Therefore, it should be understood that the particular embodiments shown in the drawings and described within this specification are for the purpose of example and should not be construed to limit the invention that will be described in the claims below. Now that a number of examples of the apparatus and method of the invention have been given, numerous other applications should be evident to one skilled in the art. Further, it is evident that those skilled in the art may now make numerous uses and modifications of the specific embodiments described without departing from the inventive concepts disclosed herein. It should be obvious that the various members described may be made from a variety of materials and using a wide combination of dimensions. Consequently, the invention is to be construed as embracing each and every novel feature and novel combination of the features present in or possessed by the apparatus and methods described herein.

What is claimed is:

1. A game card sorter for sorting a deck of a plurality of game cards into a predetermined sequence of values, each of said game cards having a face, said face having characters indicating a value, said game card sorter comprising:

a means for presenting said game cards to said reading means;

a tray having a sequence of slots, said tray having at least as many slots as number of game cards in said plurality of game cards;

means for moving said plurality of game cards into said slots of said tray according to said predetermined sequence;

means for selectively positioning the tray to receive a game card in one of the slots from the moving means a controller connected to said reading means and said moving means, said controller controlling the reading of each of said plurality of game cards by said reading means, identifying the value of each of the game cards, and controlling the moving means to move said game cards into said slots of said tray according to said predetermined sequence of values; and a means for dispensing the deck in the predetermined sequence.

2. A game card sorter for sorting a plurality of game cards into a predetermined sequence of values, each of said game cards having a face, said face having characters indicating a value, said game card sorter comprising:

means for reading said characters on said face of a game card of said plurality of game cards;

means for presenting said game card to said reading means;

a tray having a sequence of slots, said tray having at least as many slots as number of cards in said plurality of game cards;

means for moving a game card from said presenting means into one of said slots of said tray;

means for selectively positioning said tray to receive a game card in one of said slots from said moving means;

a controller connected to said reading means, said moving means, and said positioning means, said controller controlling the reading of each of said plurality of game cards by said reading means, identifying the value of each card, and controlling the moving means to move each of said cards to a slot of said tray positioned by said positioning means according to said predetermined sequence of values.

3. The game card sorter of claim 2 further comprising:

a means for removing game cards from said tray.

4. A method for sorting a deck of a plurality of game cards into a predetermined sequence, each of said plurality of game cards having a face with characters indicating a value, said method comprising the steps of:

(a) providing a tray having a sequence of slots, said tray having at least as many slots as number of game cards in said plurality of game cards;

means for selectively positioning the tray to receive a game card in one of the slots from the moving means (b) determining a predetermined sequence of values for said plurality of game cards;

(c) reading the face of each of the game cards of said plurality of game cards to determine the value of game cards;

(d) moving said game cards into one of said plurality of slots of said tray, the position of said one slot of said tray corresponding to the position of said value in said predetermined sequence;

(e) repeating steps (c)–(d) until all of said plurality of game cards have been read and moved into said tray;

(f) moving the game cards from the plurality of slots into the deck in the predetermined sequence; and (g) expelling the deck from the game card sorter.

* * * * *